US011236760B2

(12) United States Patent
Yang et al.

(10) Patent No.: US 11,236,760 B2
(45) Date of Patent: Feb. 1, 2022

(54) IMPELLER AND FAN

(71) Applicant: DELTA ELECTRONICS, INC., Taoyuan (TW)

(72) Inventors: Chao-Fu Yang, Taoyuan Hsien (TW); Li-Han Hung, Taoyuan (TW); Jen-Bo Huang, Taoyuan (TW); Shun-Chen Chang, Taoyuan Hsien (TW); Kuo-Tung Hsu, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 230 days.

(21) Appl. No.: 16/710,739

(22) Filed: Dec. 11, 2019

(65) Prior Publication Data

US 2020/0116159 A1 Apr. 16, 2020

Related U.S. Application Data

(63) Continuation-in-part of application No. 15/010,648, filed on Jan. 29, 2016, now Pat. No. 10,539,149.

(30) Foreign Application Priority Data

Dec. 11, 2015 (CN) ..... 201510923160.8

(51) Int. Cl.
*F04D 29/38* (2006.01)
*F04D 29/32* (2006.01)
*F04D 19/00* (2006.01)

(52) U.S. Cl.
CPC ..... *F04D 29/384* (2013.01); *F04D 29/325* (2013.01); *F04D 29/328* (2013.01);
(Continued)

(58) Field of Classification Search
CPC .... F04D 29/388; F04D 29/325; F04D 29/384; F04D 29/66; F04D 29/661
See application file for complete search history.

(56) References Cited

U.S. PATENT DOCUMENTS 5,320,493 A 6/1994 Shih et al.
6,142,733 A 11/2000 Alizadeh et al.
(Continued)

FOREIGN PATENT DOCUMENTS

CN 1150834 A 5/1997
CN 1796798 A 7/2006
(Continued)

OTHER PUBLICATIONS

Korean Abstract of KR1020070066240, Accessed Korean Patent Office website on Sep. 18, 2018 (2018).

*Primary Examiner* — Richard A Edgar
(74) *Attorney, Agent, or Firm* — Muncy, Geissler, Olds & Lowe, P.C.

(57) ABSTRACT

An impeller includes a hub and blades. In radial direction, an upper surface of the blade near the outer edge includes a groove structure, a lower surface of the blade relating to the groove structure includes a peak structure, the lower surface of the blade includes a recess structure aside the trailing edge or the leading edge. The recess structure is connected to the peak structure. The blade has at least five airfoils from the inner edge to the outer edge. The blade is defined by continuously connecting the at least five airfoils at different sections in sequence so as to form the groove structure and the peak structure respectively on the upper surface and the lower surface. The groove structure and the peak structure are aside the outer edge of the blade.

20 Claims, 16 Drawing Sheets

(52) U.S. Cl.
CPC ..... *F04D 19/002* (2013.01); *F05D 2240/303* (2013.01); *F05D 2240/304* (2013.01)

(56) References Cited

U.S. PATENT DOCUMENTS

| | | | | |
|---|---|---|---|---|
| 7,559,744 | B2 | 7/2009 | Suzuki et al. | |
| 2005/0276693 | A1 | 12/2005 | Liu | |
| 2010/0189557 | A1 | 7/2010 | Broom | |
| 2011/0150639 | A1* | 6/2011 | Chen | F04D 29/544 415/182.1 |
| 2014/0086754 | A1 | 3/2014 | Seiji et al. | |
| 2014/0338388 | A1 | 11/2014 | Kim et al. | |
| 2015/0071786 | A1 | 3/2015 | Kumon et al. | |
| 2018/0238343 | A1* | 8/2018 | Nakashima | F04D 29/667 |

FOREIGN PATENT DOCUMENTS

| | | | |
|---|---|---|---|
| CN | 101725566 | A | 6/2010 |
| CN | 201496290 | U | 6/2010 |
| KR | 1020070066240 | A | 6/2007 |
| WO | WO-96/33345 | | 10/1996 |
| WO | WO-2015092924 | A1 | 6/2015 |

* cited by examiner

IMPELLER AND FAN

CROSS REFERENCE TO RELATED APPLICATIONS

This Non-provisional application is a Continuation-In-Part (CIP) application of U.S. application Ser. No. 15/010,648, which claims priority under 35 U.S.C. § 119(a) on Patent Application No(s). 201510923160.8 filed in People's Republic of China on Dec. 11, 2015, the entire contents of which are hereby incorporated by reference

BACKGROUND

Technical Field

The invention relates to an impeller and fan.

Related Art

Fans can be classified into axial fan and centrifugal fan according to direction relationship between fan inlet and outlet. In ordinary axial fan, airflow flows into the inlet and flows out from the outlet. The airflow into the inlet and the airflow from the outlet flow toward almost the same direction.

Generally, an axial fan is designed by stacking 2-4 sections of fan blades based on NACA 4-digit or 5-digit airfoil. These airfoils at different sections are continuously connected by lines and surfaces to form a three-dimensional blade. However, this design method can not easily give enough detail description of the surface of the fan blade. Moreover, to hold curvature continuity of fan blade, it is not easy to add extra variation on segments of the fan blade. Moreover, the maximum orientation angle of the blade of the traditional quiet fan is between 25 degrees to 36 degrees. If applying greater orientation angle, fan characteristics becomes worse instead.

SUMMARY

In one embodiment, an impeller includes a hub and a plurality of blades surrounding the hub. The hub includes a shaft. In the rotation direction of the impeller, each blade includes an inner edge, a leading edge, an outer edge, a middle portion and a trailing edge. The leading edge, the outer edge and the trailing edge are around three sides of the middle portion. In radial direction, an upper surface of the blade near the outer edge includes a groove structure, a lower surface of the blade relating to the groove structure includes a peak structure, the lower surface of the blade includes a recess structure aside the trailing edge or the leading edge. The recess structure is connected to the peak structure. The blade has at least five airfoils from the inner edge to the outer edge. The blade is defined by continuously connecting the at least five airfoils at different sections in sequence so as to form the groove structure and the peak structure respectively on the upper surface and the lower surface. The groove structure and the peak structure are aside the outer edge of the blade. A depth of the groove structure varies from the leading edge to the trailing edge. A height of the peak structure varies from the leading edge to the trailing edge. Variations of the groove structure and the peak structure are continuous and gradual on the upper surface and the lower surface.

In one embodiment, the recess structure is connected to the outer edge.

In one embodiment, the recess structure is connected to the trailing edge or the leading edge.

In one embodiment, the lower surface has a zone from the trailing edge toward the leading edge to a recess border, a ratio of a distance between the recess border and the trailing edge to a distance between the recess border and the leading edge is smaller than 1/2, the recess structure is within the zone aside the trailing edge and is not beyond the recess border.

In one embodiment, the lower surface has a zone from the leading edge toward the trailing edge to a recess border, a ratio of a distance between the recess border and the leading edge to a distance between the recess border and the trailing edge is smaller than 1/2, the recess structure is within the zone aside the leading edge and is not beyond the recess border.

In one embodiment, an area of the recess structure at the lower surface is smaller than 1/3 of a total area of the lower surface.

In one embodiment, each one of the blades has a forefront point, when viewing the upper surfaces of the blades, a plurality of imaginary lines are from the shaft respectively to the forefront points, every two adjacent imaginary lines define one included angle, the included angles are distinct from each other.

In one embodiment, the groove structure is connected to the leading edge and the trailing edge, and the peak structure is connected to the leading edge and the trailing edge.

In one embodiment, an impeller includes a hub and a plurality of blades surrounding the hub. The hub includes a shaft. In the rotation direction of the impeller, each blade includes an inner edge, a leading edge, an outer edge, a middle portion and a trailing edge. The leading edge, the outer edge and the trailing edge are around three sides of the middle portion. In radial direction, an upper surface of the blade near the outer edge includes a groove structure, a lower surface of the blade relating to the groove structure includes a peak structure, the lower surface of the blade includes a recess structure aside the trailing edge or the leading edge. The recess structure is connected to the peak structure. The recess structure is connected to the outer edge. The recess structure is connected to the trailing edge or the leading edge. The blade has at least five airfoils from the inner edge to the outer edge. The blade is defined by continuously connecting the at least five airfoils at different sections in sequence so as to form the groove structure and the peak structure respectively on the upper surface and the lower surface. The groove structure and the peak structure are aside the outer edge of the blade. A depth of the groove structure varies from the leading edge to the trailing edge. A height of the peak structure varies from the leading edge to the trailing edge. Variations of the groove structure and the peak structure are continuous and gradual on the upper surface and the lower surface.

In one embodiment, an area of the recess structure at the lower surface is smaller than 1/3 of a total area of the lower surface. Each one of the blades has a forefront point. When viewing the upper surfaces of the blades, a plurality of imaginary lines are from the shaft respectively to the forefront points. Every two adjacent imaginary lines define one included angle. The included angles are distinct from each other. The groove structure is connected to the leading edge and the trailing edge, and the peak structure is connected to the leading edge and the trailing edge.

In one embodiment, an impeller includes a hub and a plurality of blades surrounding the hub. The hub includes a shaft. In the rotation direction of the impeller, each blade includes an inner edge, a leading edge, an outer edge, a middle portion and a trailing edge. The leading edge, the outer edge and the trailing edge are around three sides of the middle portion. In radial direction, an upper surface of the blade near the outer edge includes a groove structure, a lower surface of the blade relating to the groove structure includes a peak structure, the lower surface of the blade includes a recess structure aside the trailing edge or the leading edge. The blade has at least five airfoils from the inner edge to the outer edge. The blade is defined by continuously connecting the at least five airfoils at different sections in sequence so as to form the groove structure and the peak structure respectively on the upper surface and the lower surface. The groove structure and the peak structure are aside the outer edge of the blade.

In one embodiment, the recess structure is connected to the peak structure.

In one embodiment, the recess structure is connected to the outer edge.

In one embodiment, the recess structure is connected to the trailing edge or the leading edge.

In one embodiment, the lower surface has a zone from the trailing edge toward the leading edge to a recess border, a ratio of a distance between the recess border and the trailing edge to a distance between the recess border and the leading edge is smaller than 1/2, the recess structure is within the zone aside the trailing edge and is not beyond the recess border.

In one embodiment, the lower surface has a zone from the leading edge toward the trailing edge to a recess border, a ratio of a distance between the recess border and the leading edge to a distance between the recess border and the trailing edge is smaller than 1/2, the recess structure is within the zone aside the leading edge and is not beyond the recess border.

In one embodiment, an area of the recess structure at the lower surface is smaller than 1/3 of a total area of the lower surface.

In one embodiment, each one of the blades has a forefront point, when viewing the upper surfaces of the blades, a plurality of imaginary lines are from the shaft respectively to the forefront points, every two adjacent imaginary lines define one included angle, the included angles are distinct from each other.

In one embodiment, a depth of the groove structure varies along a direction from the leading edge to the trailing edge, a height of the peak structure varies along the direction from the leading edge to the trailing edge, and variations of the groove structure and the peak structure are continuous and gradual on the upper surface and the lower surface.

In one embodiment, the groove structure is connected to the leading edge and the trailing edge, and the peak structure is connected to the leading edge and the trailing edge.

In one embodiment, the previous mentioned impeller is used in a fan.

In summary, as to the impeller and the fan blade, from the shaft of the hub outwardly, the height of the leading edge to the horizontal plane of the lowest position of the blade gradually decreases first and then gradually increases. When the fan rotates, the magnitude of the airstream from the lower surface of the blade cause by the pressure difference between the upper and lower surfaces of the blade can be reduced. Thus, the turbulence on the blade and noise can be reduced. Moreover, in radial direction, the upper surface of the blade near the outer edge includes a groove structure, and the lower surface of the blade relating to the groove structure includes a peak structure. Therefore, the noise and turbulence caused by the rotational impeller can be reduced. Such blade design can raise air pressure and air volume and reduce noise. In addition, the recess structure on the lower surface of the blade is designed for raising air pressure. With the recess structure as well as the unequal pitch between blades, noise also can be reduced. Thus, the material cost is reduced and performance of the device is enhanced.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1A:
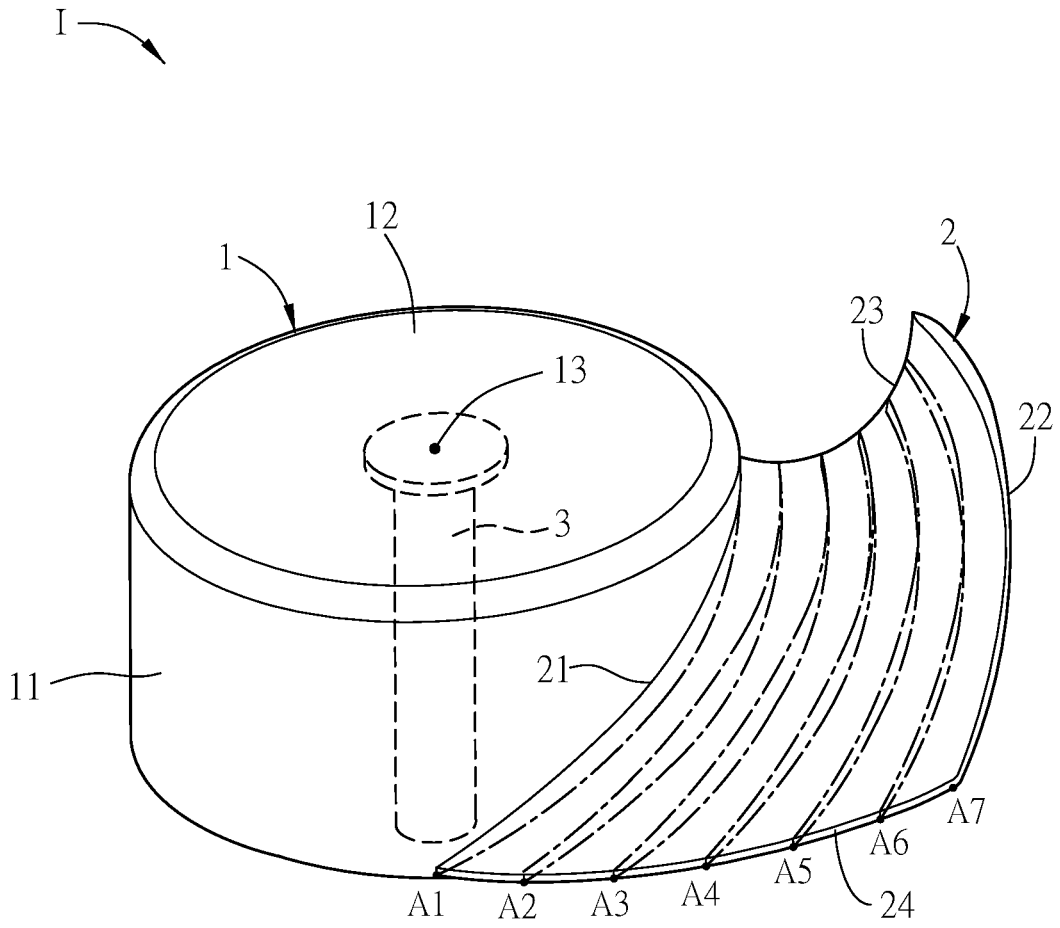
FIG. 1A to FIG. 1C are perspective diagrams of the impeller according to one embodiment.
Figure 1B:
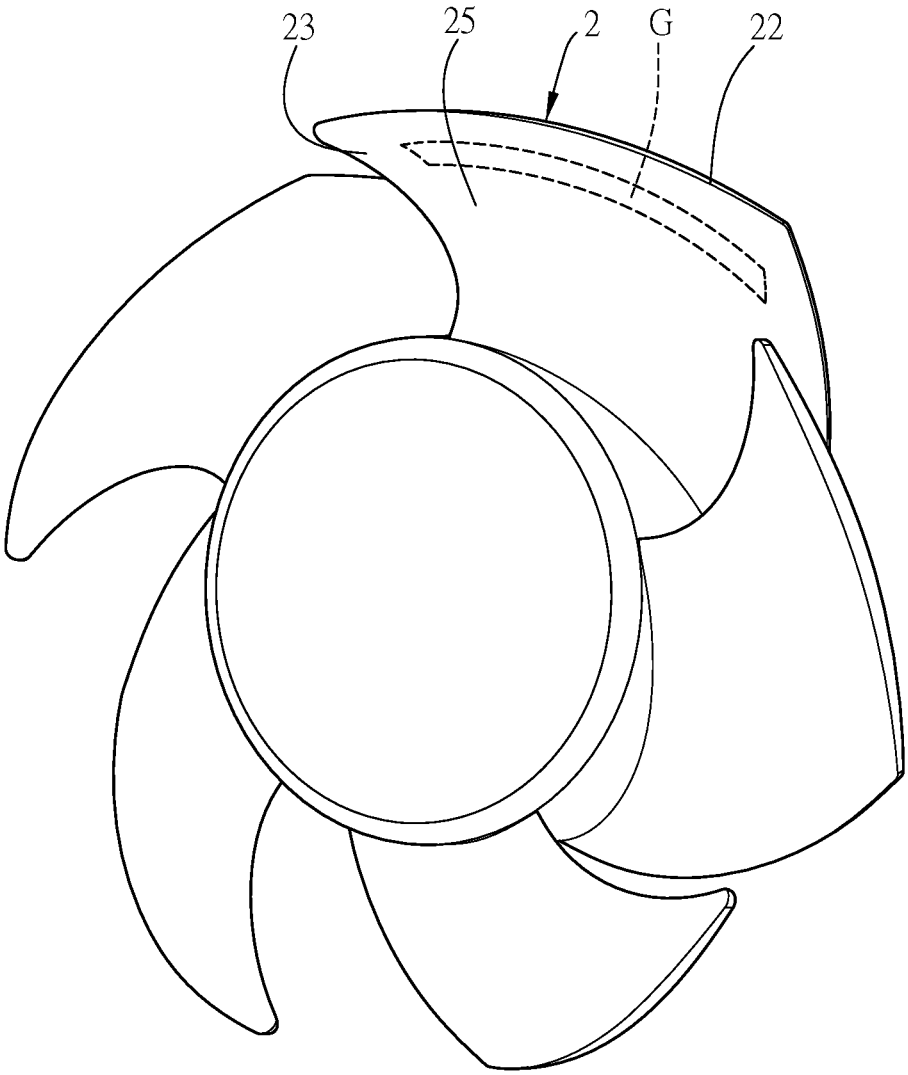
Figure 1C:
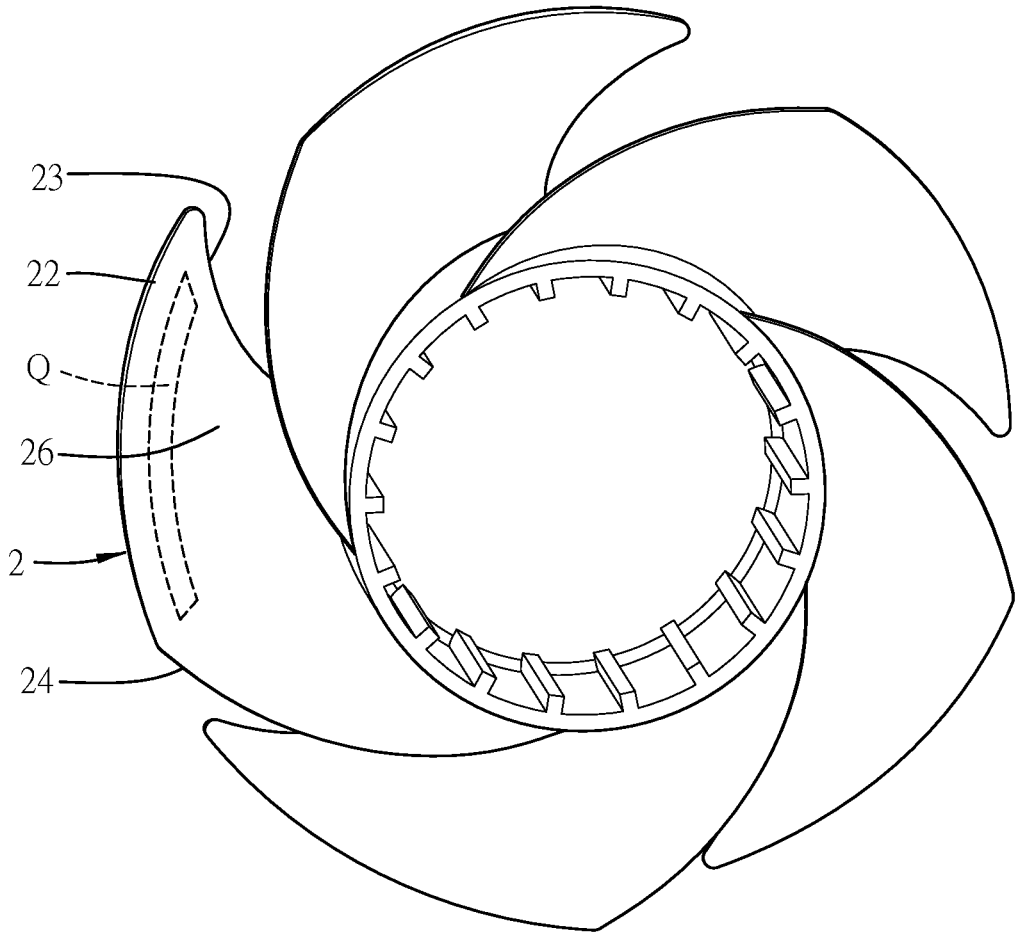
Figure 1D:
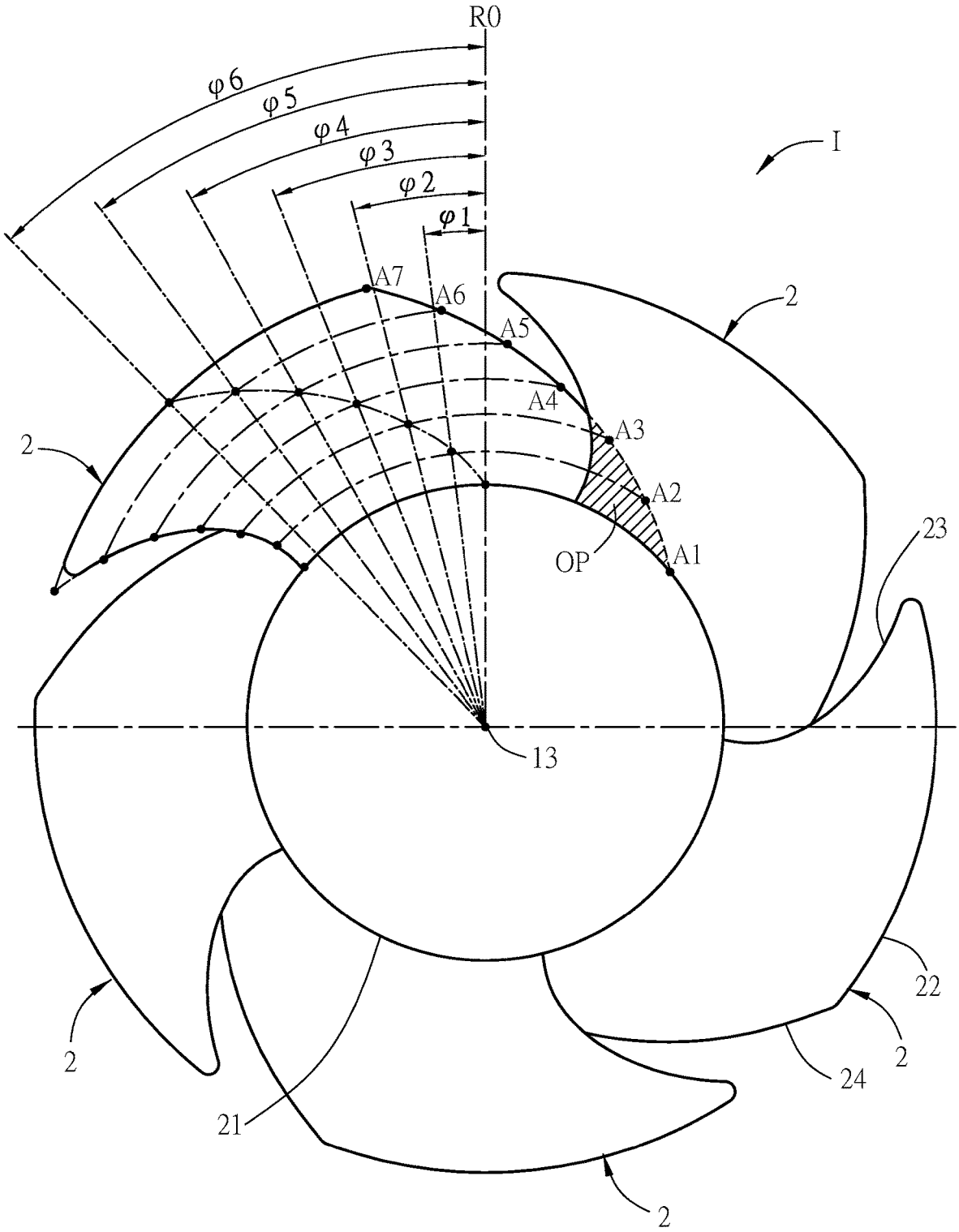
FIG. 1D is a top view of the impeller in FIG. 1A.
Figure 1E:
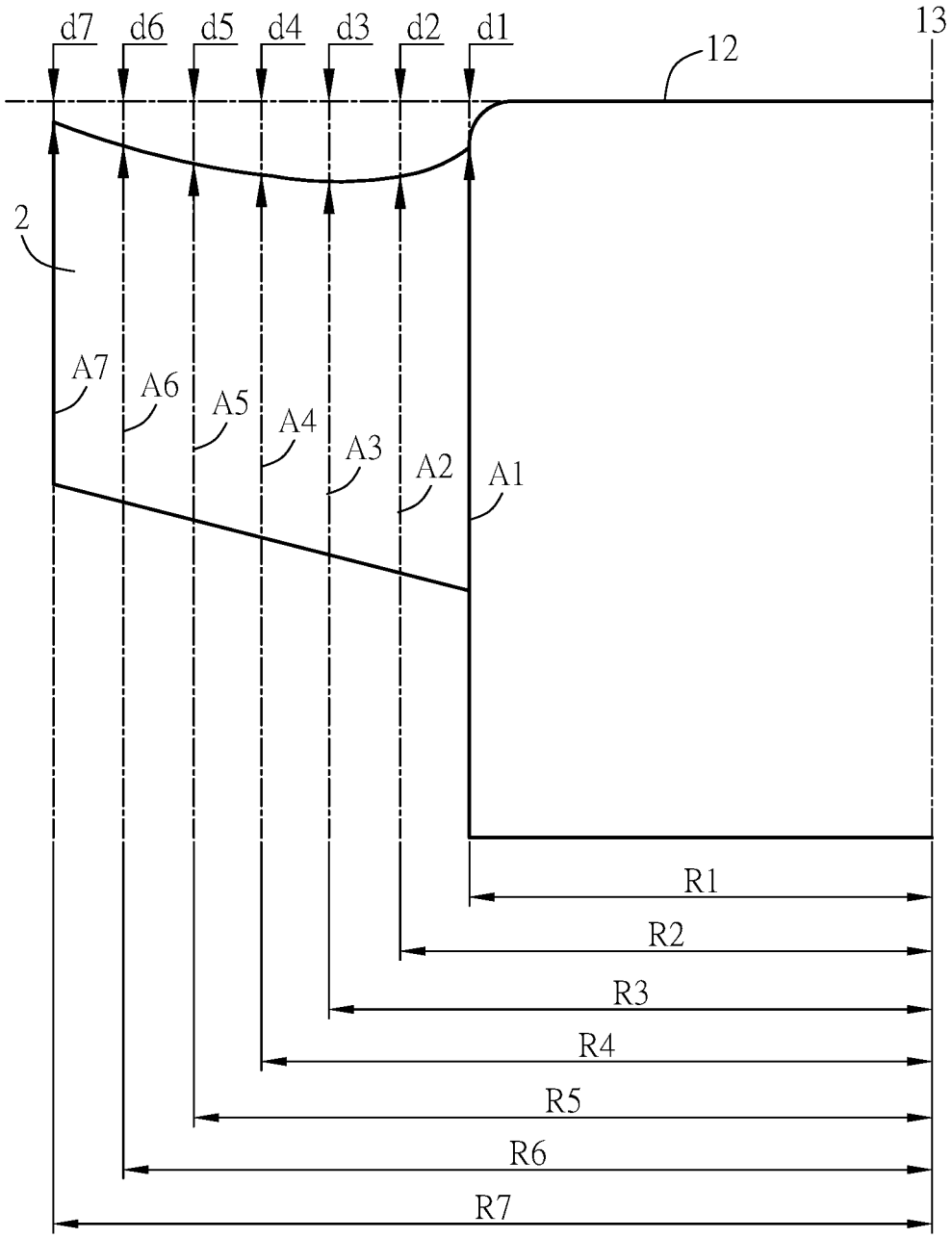
FIG. 1E is a half view of the impeller in 1A.

FIG. 1A to FIG. 1C are perspective diagrams of the impeller I according to one embodiment. FIG. 1D is a top view of the impeller I in FIG. 1A. FIG. 1E is a half view of the impeller I in 1A. The impeller I comprises a hub 1 and a plurality of blades 2. The blades 2 surround the hub 1. The impeller I is adapted for a fan. In the embodiment, there are five blades 2 for example. For the sake of clarity, FIG. 1A only shows one of the five blades 2.

Referring to FIG. 1A to FIG. 1C, the hub 1 has an outer surface 11, a top surface 12, a hub axis 13 and a shaft 14. In the embodiment, the hub axis 13 is perpendicular to the top surface 12, namely the extension direction of the hub axis 13 is parallel to the normal vector of the top surface 12. The hub axis 13 connects to the shaft 14.

The blades 2 connect to the outer surface 11 of the hub 1. In the rotation direction of the impeller I, each blade 2 includes an inner edge 21, a leading edge 23, an outer edge 22, a middle portion 27 and a trailing edge 24. The leading edge 23, the outer edge 22 and the trailing edge 24 are around three sides of the middle portion 27. From the shaft 14 of the hub 1 outwardly, the height of the leading edge 23 to the horizontal plane of the lowest position of the blade 2 gradually decreases first and then gradually increases. In radial direction, the upper surface 25 of the blade 2 near the outer edge 22 includes a groove structure G, and the lower surface 26 of the blade 2 relating to the groove structure G includes a peak structure Q. The groove structure G extends from near the leading edge 23 toward the trailing edge 24, and the depth of the groove structure G gradually becomes deeper first and then gradually becomes shallower. The peak structure Q extends from near the leading edge 23 toward the trailing edge 24, and the height of the peak structure Q gradually becomes protrusive and then gradually becomes flat.

In the embodiment, these four edges are curves but not straight lines. The inner edge 21 connects the blade 2 with the outer surface 11 of the hub 1. The outer edge 22 is disposed opposite the inner edge 21, and it is the edge of the blade 2 away from the hub 1. Besides, the leading edge 23 is the inlet edge of the blade 2 when the impeller I rotates. The trailing edge 24 is disposed opposite the leading edge 23, and it is the outlet edge of the blade 2. The inner edge 21 connects to the leading edge 23 and the trailing edge 24, and the outer edge 22 also connects to the leading edge 23 and the trailing edge 24.

The portion of the blade 2 near the hub 1 partially overlaps the previous and next blades 2 if viewed axially so as to raise air pressure and air volume. The overlap portion is labeled with symbol "OP" in FIG. 1D.

Referring to FIG. 1A, FIG. 1D and FIG. 1E, there are a plurality of airfoils A between the inner edge 21 and the outer edge 22. It is noted that the term "airfoil" refers to a curved plane instead of a flat plane. A virtual arc extends around the curved surface of the hub axis 13 and intersect the blade 2 to form the curved airfoil A. The center of curvature R related to the virtual arc is located at the extension line of the axis of the hub 1. The position of the airfoil A depends on the radius of curvature R of the virtual arc. In the embodiment, there are seven airfoils A (the $1^{st}$ airfoil A1 to the $7^{th}$ airfoil A7) for example. Seven different radiuses of curvature R (the $1^{st}$ radius of curvature R1 to the $7^{th}$ radius of curvature R7) define the positions of these airfoils A. The $1^{st}$ radius of curvature R1 to the $7^{th}$ radius of curvature R7 gradually increase in sequence. In the embodiment, the $1^{st}$ radius of curvature R1 is the same with the radius of the outer surface of the hub 1. Namely, the $1^{st}$ airfoil A1 is designated as the inner edge 21 of the blade 2, and the $7^{th}$ airfoil A7 is designated as the outer edge 22 of the blade 2.

Figure 2A:
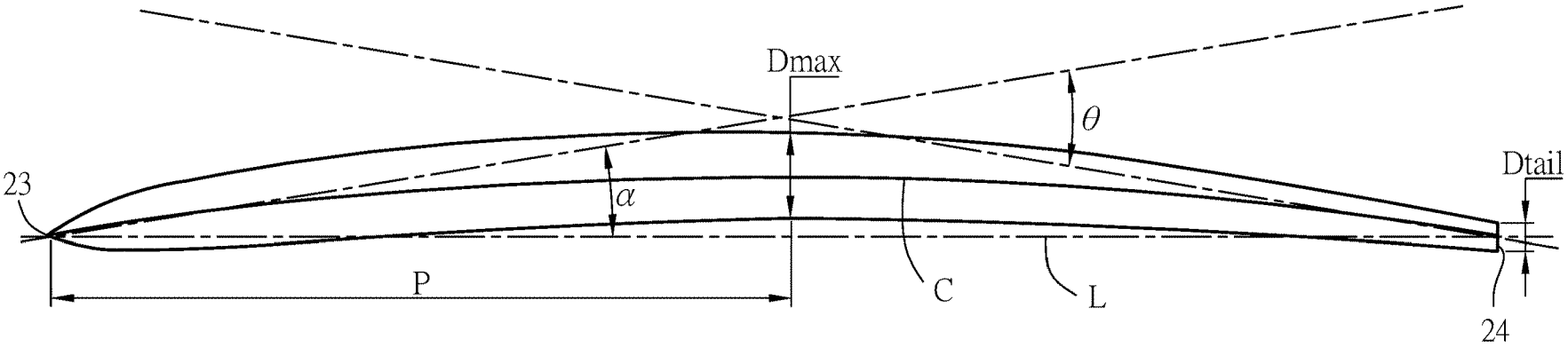
FIG. 2A is a schematic diagram of the airfoil.
Figure 2B:
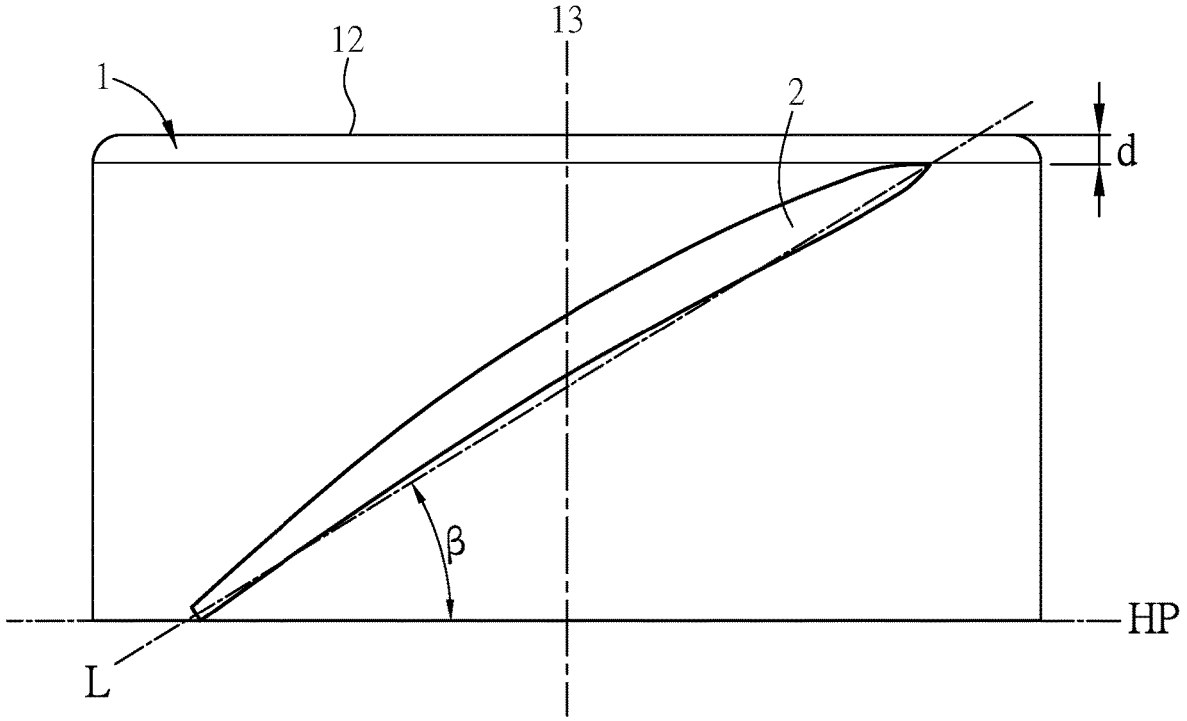
FIG. 2B is a schematic diagram of the arrangement of the airfoil.

Referring to FIG. 2A and FIG. 2B, they are respectively a schematic diagram of the airfoil and a schematic diagram of the arrangement of the airfoil. In the embodiment, each airfoil A comprises the following blade parameter:

Camber line C: a center straight line from the leading edge 23 to the trailing edge 24 on the airfoil. Namely the distance from the upper surface to the camber line C is equal to the distance from the lower surface to the camber line C. In the embodiment, there are the $1^{st}$ camber line C1 to the $7^{th}$ camber line C7 respectively for the $1^{st}$ airfoil A1 to the $7^{th}$ airfoil A7.

Chord line L: a straight line connects the leading edge 23 and the trailing edge 24, and it is also called the line for arrangement. In the embodiment, there are the $1^{st}$ chord line L1 to the $7^{th}$ chord line L7 respectively for the $1^{st}$ airfoil A1 to the $7^{th}$ airfoil A7.

Intake angle $\alpha$: the included angle between the chord line L and the direction (or vector) along which air flows to the blade 2. In the embodiment, there are the $1^{st}$ intake angle $\alpha$1 to the $7^{th}$ intake angle $\alpha$7 respectively for the $1^{st}$ airfoil A1 to the $7^{th}$ airfoil A7. In the rotation direction of the impeller I, the intake angle $\alpha$7 at the leading edge 23 and the outer edge 22 of the blade 2 is the greatest one so as to raise air pressure and air volume and to reduce noise.

Chamber angle $\theta$: the acute angle of the tangent to the camber line C at the leading edge and the tangent to the camber line C at the trailing edge. In the embodiment, there are the $1^{st}$ chamber angle $\theta$1 to the $7^{th}$ chamber angle $\theta$7 respectively for the $1^{st}$ airfoil A1 to the $7^{th}$ airfoil A7. Resulting from the intake angle, in the rotation direction of the impeller I, the intake angle $\theta$7 is the greatest one at the outer edge 22 and the leading edge 23 of the blade 2.

Blade thickness: the thickness from the upper surface of the blade to the lower surface of the blade. It includes the maximum thickness Dmax and the thickness of the trailing edge Dtail. In the embodiment, as to the maximum thickness Dmax, there are the $1^{st}$ maximum thickness Dmax1 to the $7^{th}$ maximum thickness Dmax7 respectively for the $1^{st}$ airfoil A1 to the $7^{th}$ airfoil A7. As to the thickness of the trailing edge Dtail, there are the $1^{st}$ thickness of the trailing edge Dtail1 to the $7^{th}$ thickness of the trailing edge Dtail7 respectively for the $1^{st}$ airfoil A1 to the $7^{th}$ airfoil A7. Moreover, the position of the maximum thickness Dmax may depend on the parameter P. For example, the chord line L is taken as the baseline, the leading edge 23 is taken as the starting point, and the trailing edge 24 is taken as the terminal point, so the parameter P indicates the position by percentage of the baseline. For example, if the parameter P is 20%, it implies that the distance from the maximum thickness Dmax to the trailing edge 24 is four times as long as the distance from the maximum thickness Dmax to the leading edge 23. In the embodiment, the parameter P is set 50%, namely the maximum thickness Dmax is located at the middle of the chord line L.

Therefore, depending on the above mentioned blade parameters, each airfoil A can be determined. Then, referring to FIG. 1D, FIG. 1E and FIG. 2B, each airfoil A at different radius of curvature R are set connected to the hub 1 depending on the parameters for arrangement which includes:

Stagger angle $\beta$: the included angle between the chord line L and the horizontal plane HP. In the embodiment, there are the $1^{st}$ stagger angle $\beta$1 to the 7th stagger angle $\beta$7 respectively for the $1^{st}$ airfoil A1 to the $7^{th}$ airfoil A7. The inclination of each airfoil A depends on the related stagger angle $\beta$. The $1^{st}$ stagger angle $\beta$1 to the $7^{th}$ stagger angle $\beta$7 continuously vary. For example, from the shaft 14 of the hub 1 outwardly, the stagger angle of the blade 2 gradually decreases from the $1^{st}$ stagger angle $\beta$1 to the $7^{th}$ stagger angle $\beta$7; or from the shaft 14 of the hub 1 outwardly, the stagger angle of the blade 2 gradually increases first and the gradually decreases from the $1^{st}$ stagger angle $\beta$1 to the $7^{th}$ stagger angle $\beta$7; or from the shaft 14 of the hub 1 outwardly, the stagger angle of the blade 2 gradually decreases first and the gradually increases from the $1^{st}$ stagger angle $\beta$1 to the $7^{th}$ stagger angle $\beta$7. By gradually varying the stagger angle, air pressure and air volume can be raised.

Axial arrangement position d: in the axial line, the origin is at the top surface 12, the positive direction is from the top surface 12 toward the outer surface 11, and the opposite direction is the negative direction. The axial arrangement position d is the position of the axial line where the leading edge 23 of each airfoil A is located. The axial arrangement position d may be a positive number or a negative number. Referring to FIG. 1C for example, if the axial arrangement position d is a positive number, the leading edge 23 is located below the top surface 12; if the axial arrangement position d is a negative number, the leading edge 23 is located above the top surface 12. Moreover, in the embodiment, there are the $1^{st}$ axial arrangement position d1 to the $7^{th}$ axial arrangement position d7 respectively for the $1^{st}$ airfoil A1 to the $7^{th}$ airfoil A7. In the embodiment, among the axial arrangement positions d1 to d7, the $7^{th}$ axial arrangement position d7 for the $7^{th}$ airfoil A7 is the smallest one, and the $7^{th}$ airfoil A7 at the outer edge 22 is located at the highest axial arrangement position d7. In the embodiment, the $1^{st}$ axial arrangement position d1 for the $1^{st}$ airfoil A1 is the second highest one, and the $3^{rd}$ axial arrangement position d3 for the airfoil A3 is the lowest one. Namely, the airfoils A1, A7 at the inner edge 21 and the outer edge 22 are arranged at higher axial arrangement positions, the airfoils at middle (e.g. the $3^{rd}$ airfoil A3, the $4^{th}$ airfoil A4) are arranged at lower axial arrangement positions. Thus, from the shaft 14 of the hub 1 outwardly, the height of the leading edge 23 to the horizontal plane of the lowest position of the blade 2 gradually decreases first and then gradually increases, and the leading edge 23 of the blade 2 looks like a concave shape.

Orientation angle ϕ: middle points at the middle portion 27 of the blade 2 from the hub 1 outwardly to the outermost edge are connected to form a middle virtual line. The included angle between the middle virtual line and the normal line, which is located at the junction of the middle portion and the hub 1, is the orientation angle. For each airfoil A, the hub axis 13 and the center of the middle portion 27 between the leading edge 23 and the trailing edge 24 form one line, and the included angle between this line and a baseline R0 is the orientation angle ϕ. The baseline R0 is the normal line at the junction of the middle portion and the hub 1. Namely, it is the normal line at the center of the $1^{st}$ airfoil A1. Referring to FIG. 1B in the embodiment, there are the $1^{st}$ orientation angle ϕ1 to the $6^{th}$ orientation angle ϕ6 respectively for the $2^{nd}$ airfoil A1 to the $7^{th}$ airfoil A7. The $1^{st}$ airfoil A1 and the $7^{th}$ airfoil A7 are respectively located at the inner edge 21 and the outer edge 22. The relationship between the orientation angles of the airfoils are:

$$\phi_n=(7+0.1*(n+1))+\phi_{n-1}$$

If n=6, $\phi_6=(7+0.1*(n+1))+\phi_5+\phi_6'$

In the embodiment, the orientation angle of the middle portion 27 is greater than 25 degrees to reduce noise. The orientation angle ϕ of the $7^{th}$ airfoil A7 at the outer edge 22 of the blade 2 is greater than 40 degrees, for example 44.1 degrees. Besides, $\phi_6'$ is an extra parameter. Because the $7^{th}$ airfoil A7 also depends on $\phi_6'$, its orientation angle ϕ varies greatly than others and it is further obviously bent forward. As a result, the curvature of the leading edge 23 varies greatly, and such design can reduce the noise and turbulence when the impeller I rotates.

In the embodiment, each blade 2 is defined by continuously connecting seven airfoils at different sections in sequence. For example, the relationship between each airfoil A and the hub 1 is defined based on the parameters for arrangement. After the $1^{st}$ airfoil A1 to the $7^{th}$ airfoil A7 are defined based on the blade parameters and parameters for arrangement, the blade 2 is formed by connecting the leading edge 23 of each airfoil A and lines to connect the trailing edge 24 of each airfoil A.

In the embodiment, the upper surface 25 and the lower surface 26 of the blade 2 are defined by continuously connecting at least five (for example seven) airfoils at different sections. Variations of the upper surface 25 and the lower surface 26 for example the groove structure G and the peak structure Q are continuous and gradual rather than suddenly protruding or sunk. The groove structure G and the peak structure Q are located at the $6^{th}$ airfoil A6. In comparison with the traditional fan design by stacking 2-4 sections of fan blade, the blade in the embodiment has detailed designed surface. For example the groove structure G and the peak structure Q are designed on the blade.

Figure 3A:
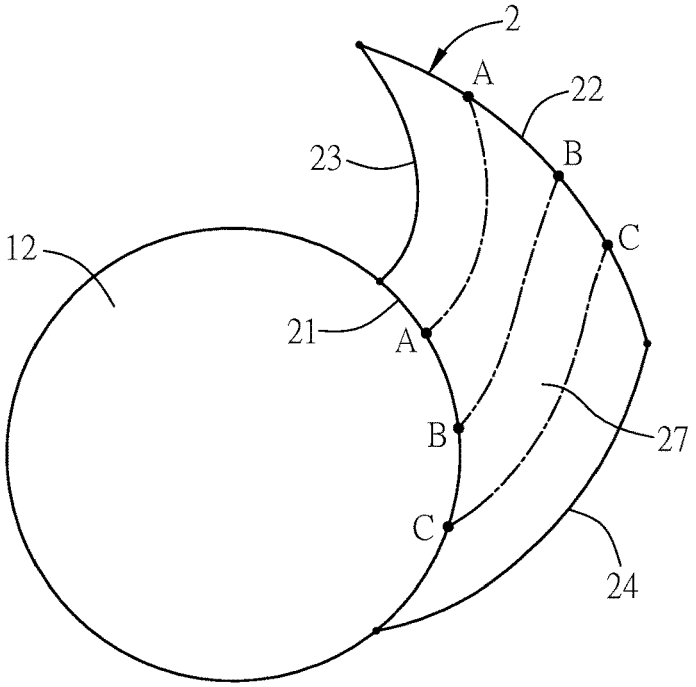
FIG. 3A is a top view showing one part of the impeller.
Figure 3B:
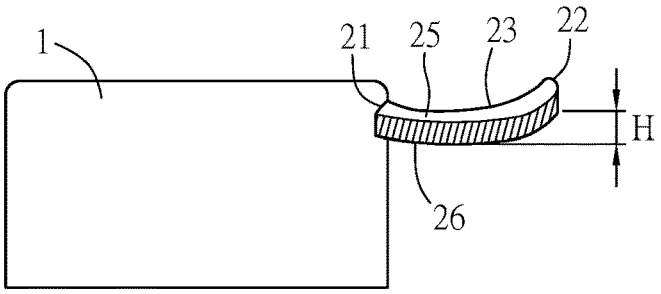
FIG. 3B is a side view of the blade along line AA in FIG. 3A.
Figure 3C:
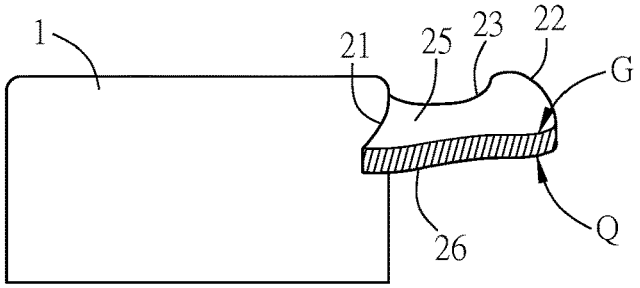
FIG. 3C is a side view of the blade along line BB in FIG. 3A.
Figure 3D:
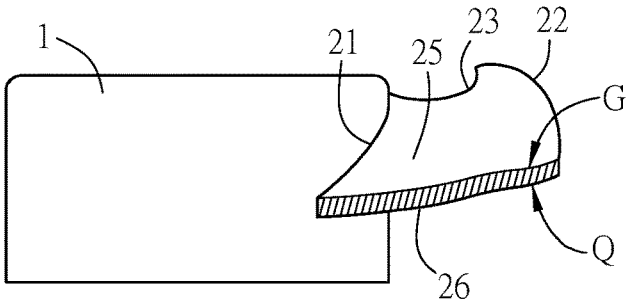
FIG. 3D is a side view of the blade along line CC in FIG. 3A.

FIG. 3A is a top view showing part of the impeller. FIG. 3B is a side view of the blade along line AA in FIG. 3A. FIG. 3C is a side view of the blade along line BB in FIG. 3A. FIG. 3D is a side view of the blade along line CC in FIG. 3A.

Referring to FIG. 3A to FIG. 3D, from the shaft 14 of the hub 1 outwardly, the height of the leading edge 23 to the horizontal plane of the lowest position of the blade 2 gradually decreases first and then gradually increases, and the leading edge 23 looks like a concave shape. In radial direction, the upper surface 25 of the blade 2 near the outer edge 22 includes a groove structure G, and the lower surface 26 of the blade 2 relating to the groove structure G includes a peak structure Q. Most of the groove structure G and the peak structure Q are located at the $6^{th}$ airfoil A6. If viewing from the upper surface 25, most of the $6^{th}$ airfoil A6 at the middle portion 27 is shorter than the $5^{th}$ airfoil A5 and the $7^{th}$ airfoil A7 so it looks like a groove locally. If viewing from the lower surface 26, most of the $6^{th}$ airfoil A6 at the middle portion 27 is shorter than the $5^{th}$ airfoil A5 and the $7^{th}$ airfoil A7 so it looks like a peak locally.

The outer edge 22 is configured based on the $7^{th}$ airfoil A7 in FIG. 2B. Because the orientation angle of the $7^{th}$ airfoil A7 is much greater than that of the inside airfoil, it is seen that the leading edge 23 of the blade 2 at the outer edge 22 protrudes forwardly if viewing the hub 1 from above the top surface 12. Moreover, because the $7^{th}$ airfoil A7 is located at the highest $7^{th}$ axial arrangement position d7, the outer edge 22 near the leading edge 23 protrudes upwardly at side view. Thus, on the whole, the outer edge 22 near the leading edge 23 protrudes upwardly.

Moreover, in the embodiment, because the parameter P of the airfoil is set 50%, the maximum thickness Dmax of these airfoils are located at the middle of the chord line L. Taking the hub axis 13 as the center from the leading edge 23 of the $7^{th}$ airfoil A7 to the maximum thickness Dmax, the outer edge 22 is still higher than other airfoils. Thus, one curve section of the outer edge 22 from the leading edge 23 to the trailing edge 23 protrudes upwardly.

Because the shape of the blade 2 from the inner edge 21 to the outer edge 22 does not vary linearly, the blade 2 has an upward protrusion at the outer edge 22 near the leading edge 23. As shown in FIG. 3B, the lower surface 26 has a height difference H between the lowest and the highest at line AA. Therefore, by the upward protrusion at the outer edge 22 of the blade 2, when the fan F rotates, it can reduce the magnitude of the airstream from the lower surface of the blade 2 caused by the pressure difference between the upper and lower surfaces of the blade 2. Thus, the turbulence on the blade 2 and noise can be reduced.

In the embodiment, the shapes of the groove structure G and the peak structure Q smoothly and gradually vary respectively at the upper surface and the lower surface, and these shapes do not vary greatly. Thus, these structures have negative impact on fan as little as possible, and they can raise air pressure and air volume and reduce noise.

Figure 4A:
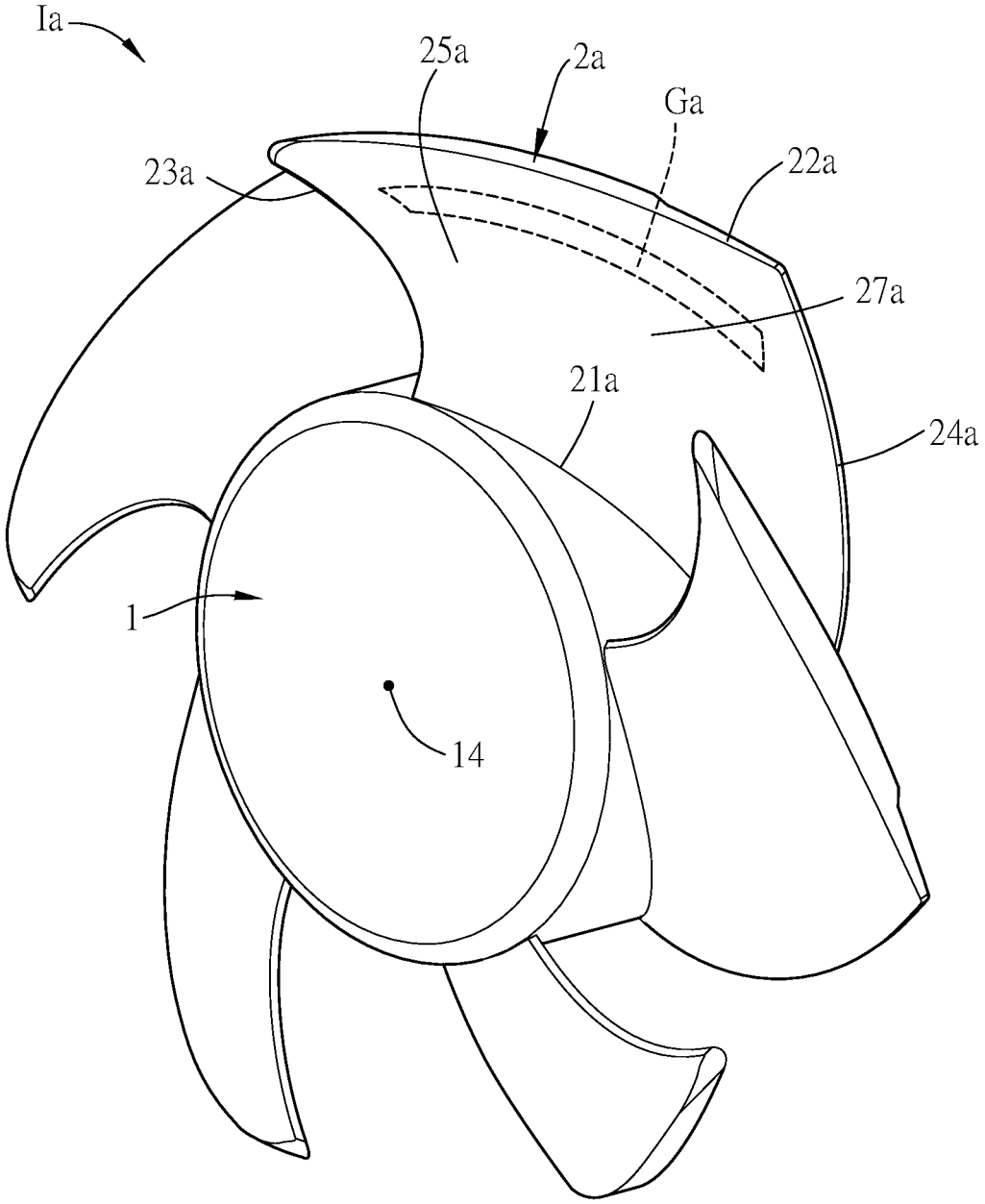
FIG. 4A and FIG. 4B are perspective diagrams of the impeller according to one embodiment.
Figure 4B:
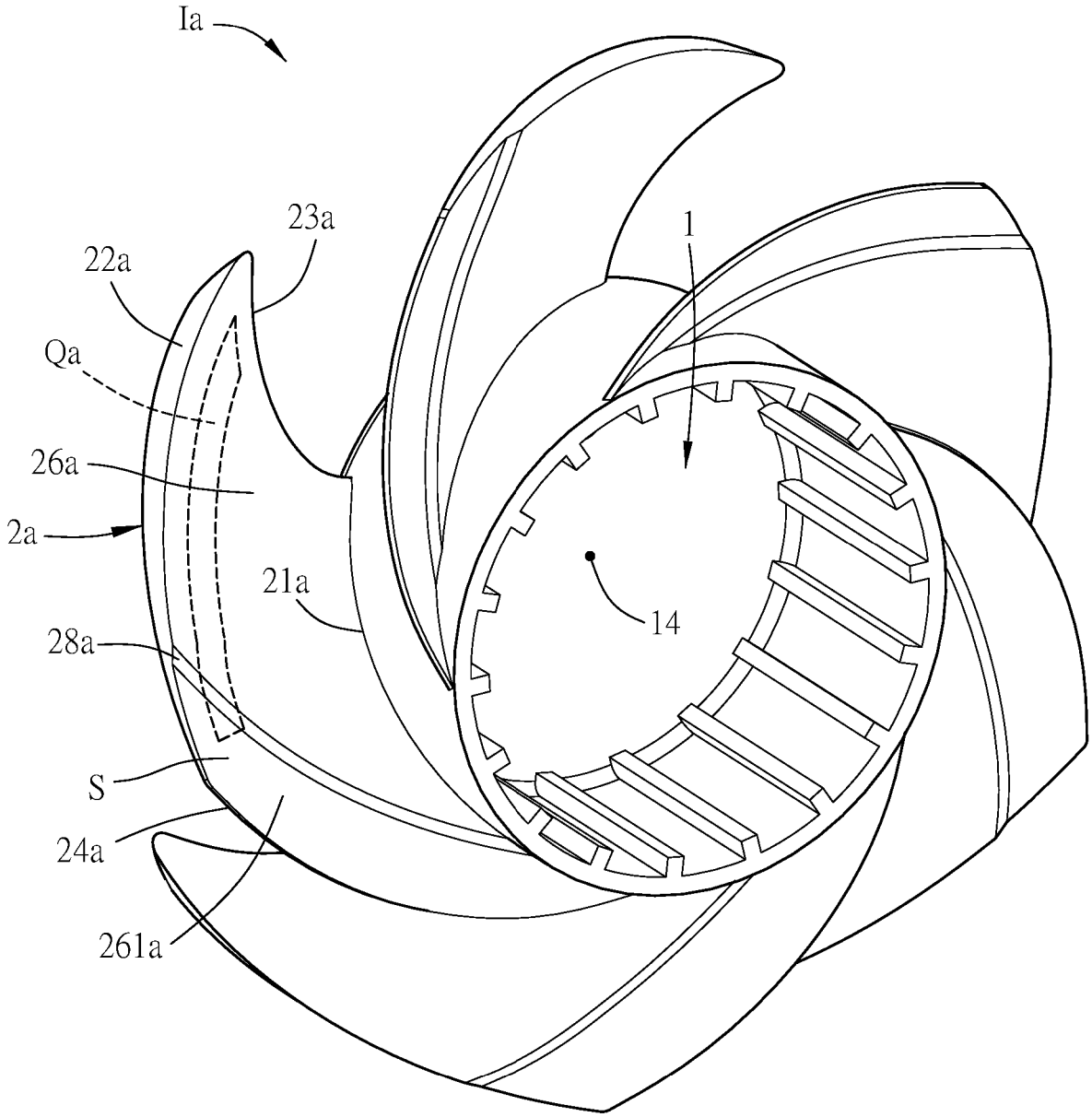
Figure 4C:
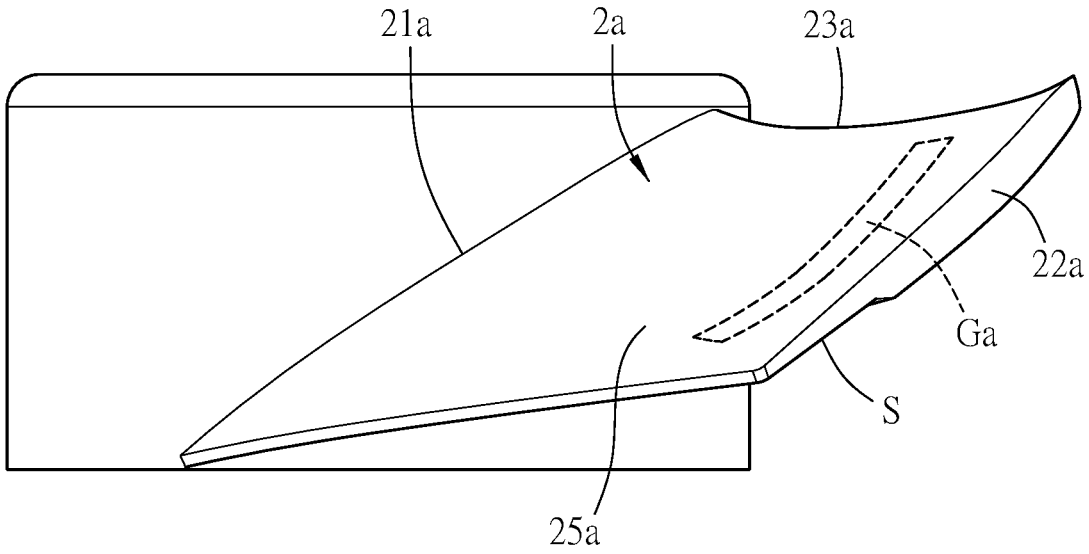
FIG. 4C is a partial enlarged view of the impeller in FIG. 4A.
Figure 4D:
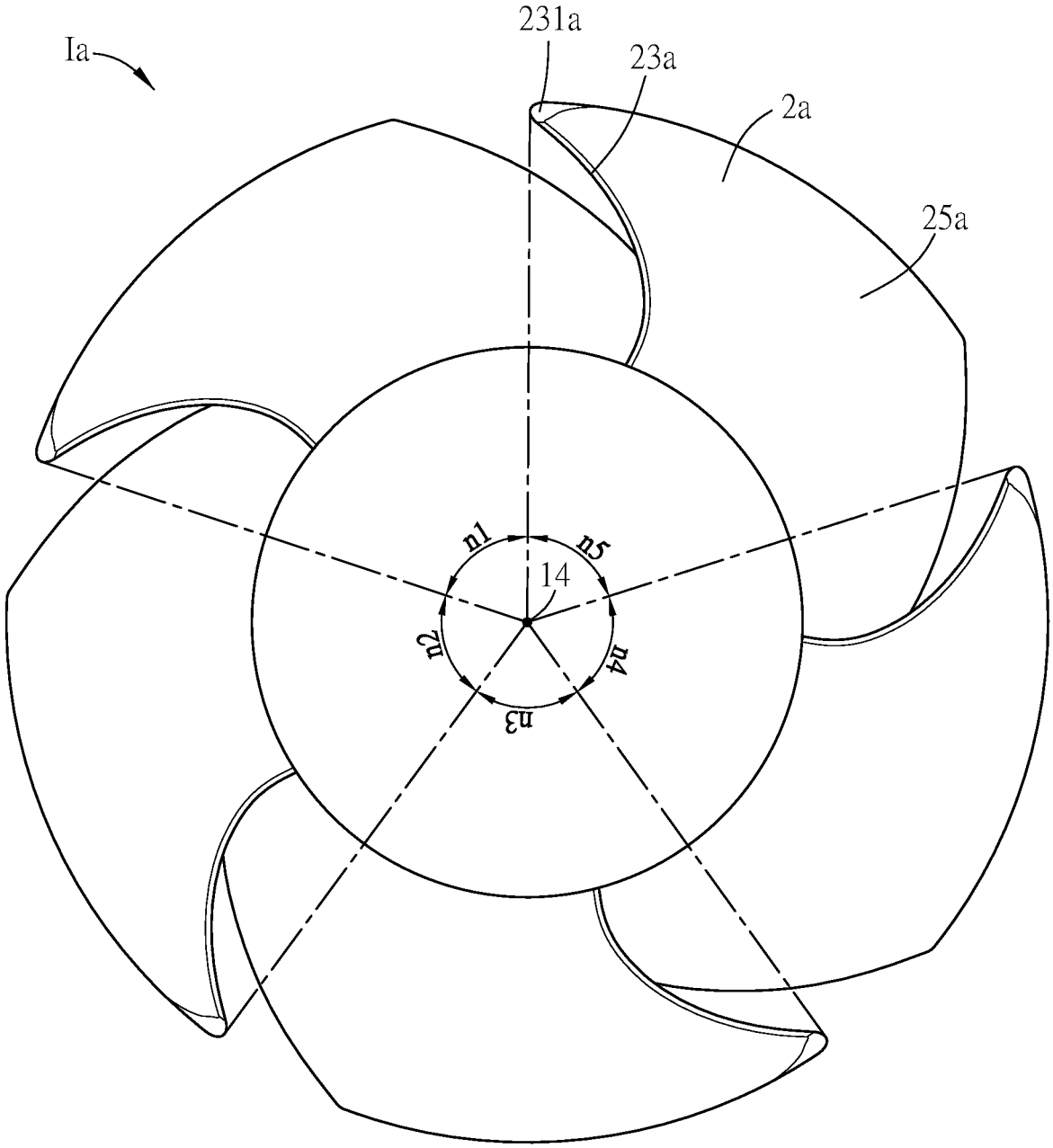
FIG. 4D is a top view of the impeller in FIG. 4A.
Figure 5A:
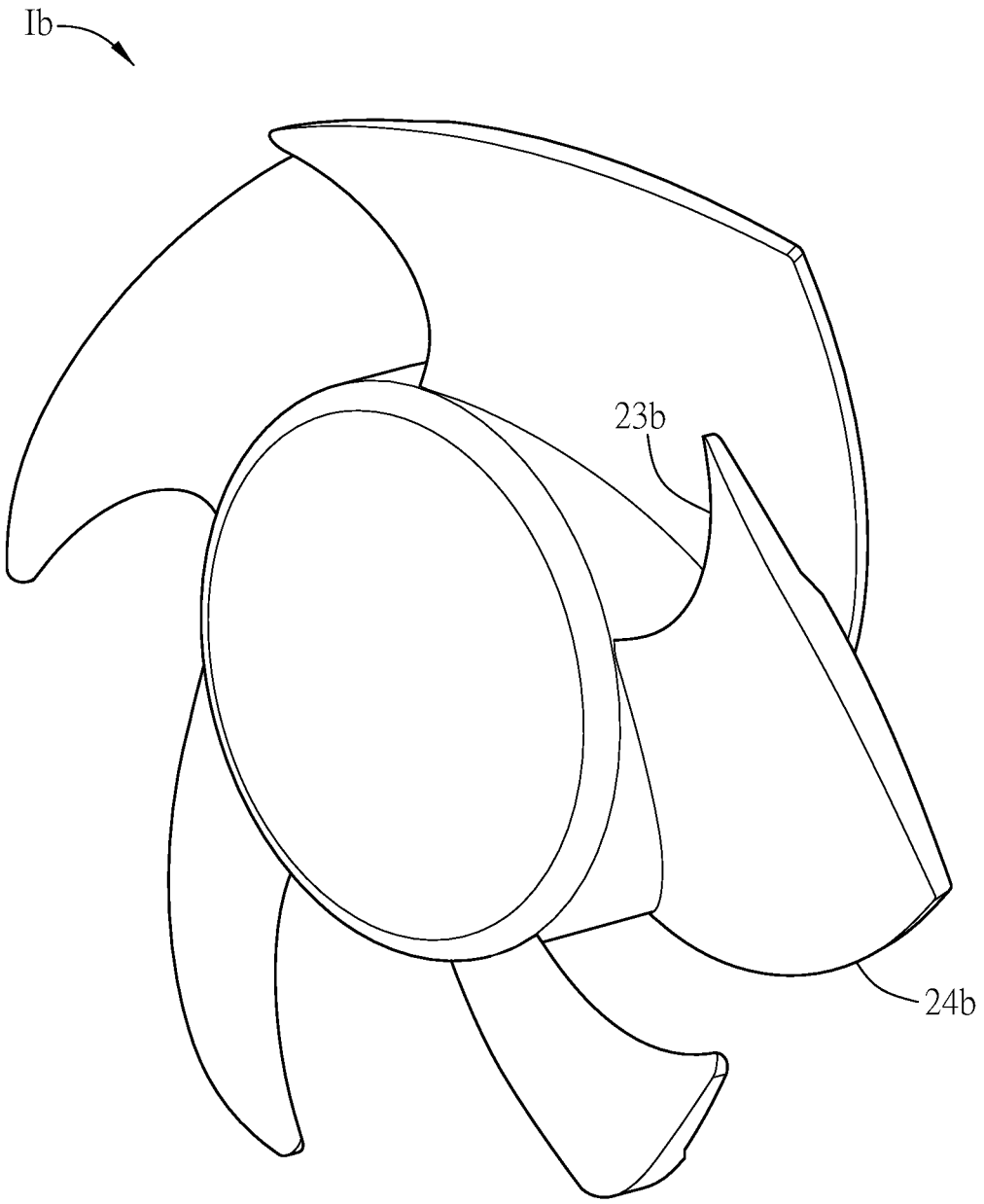
FIG. 5A and FIG. 5B are perspective diagrams of the impeller according to one embodiment.
Figure 5B:
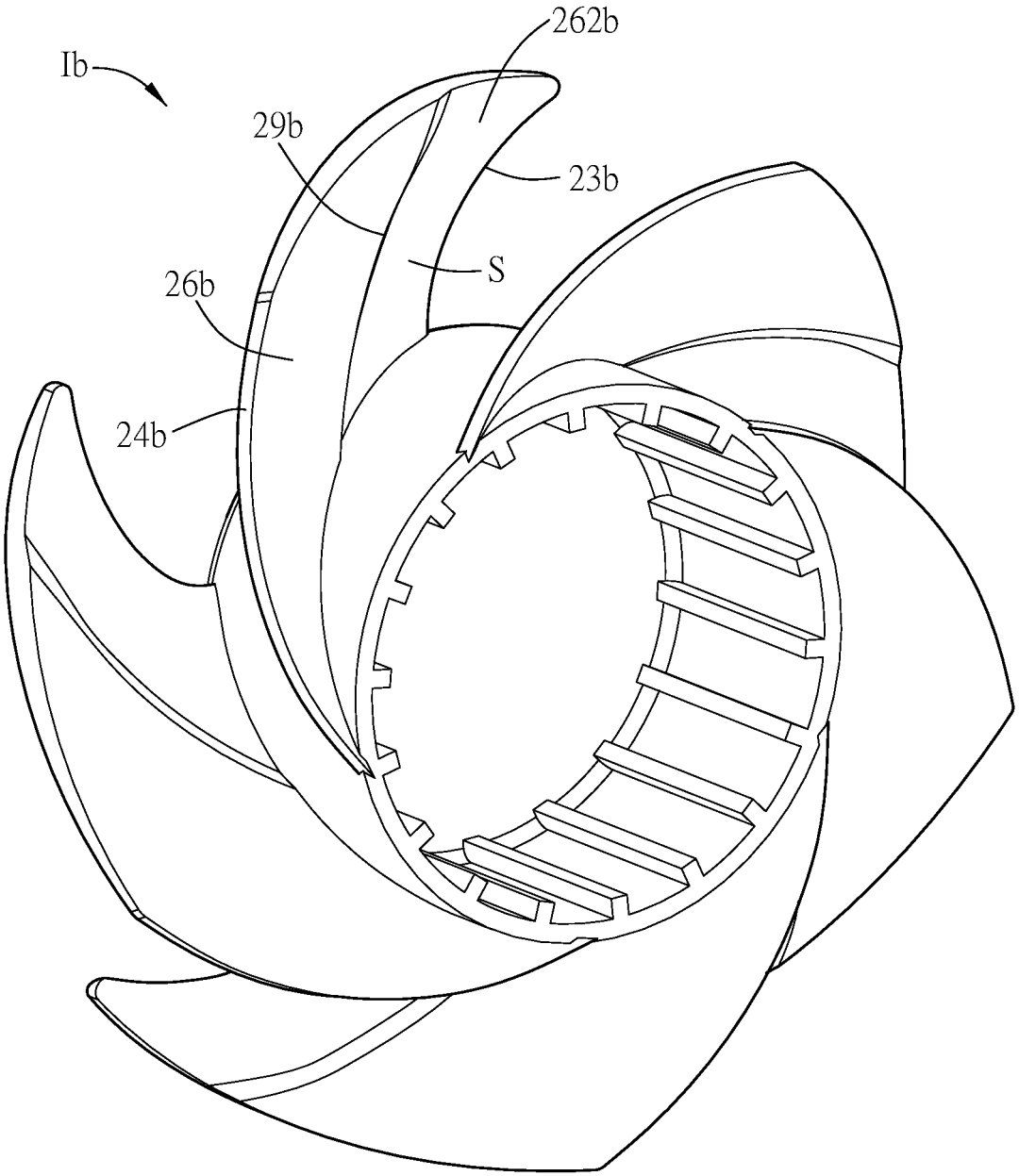
Figure 6A:
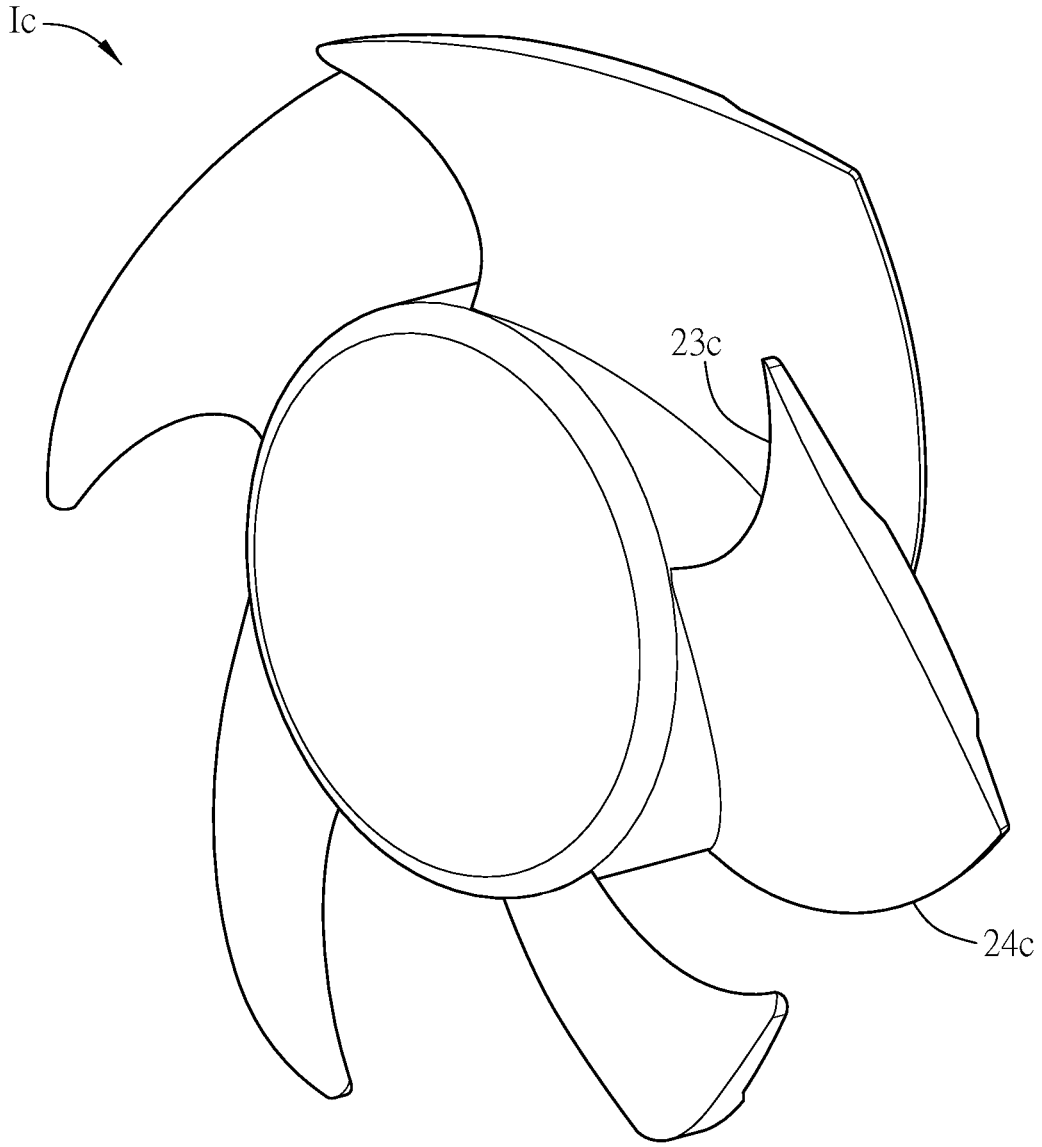
FIG. 6A and FIG. 6B are perspective diagrams of the impeller according to one embodiment.
Figure 6B:
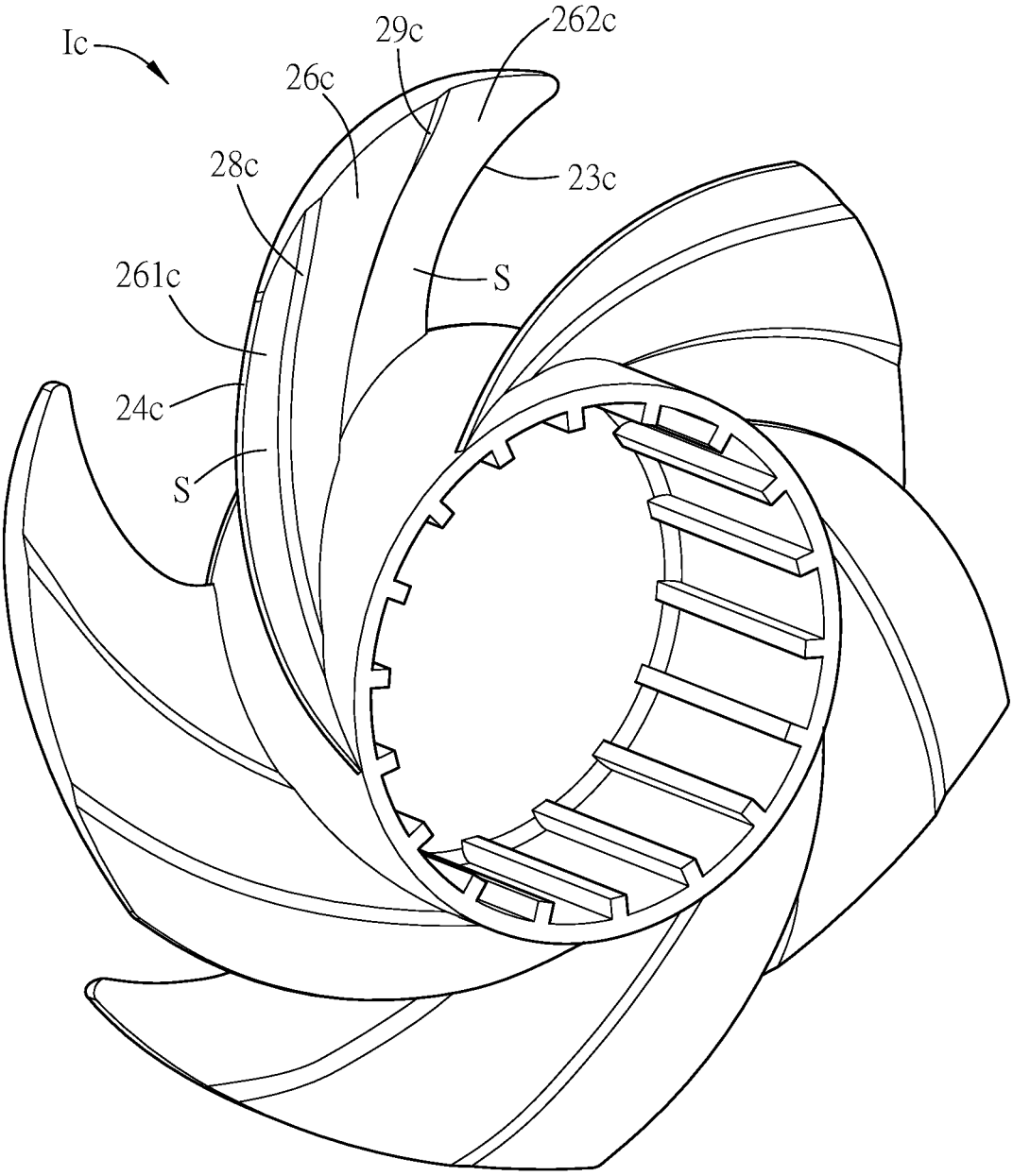

FIG. 4A and FIG. 4B are perspective diagrams of the impeller according to one embodiment. FIG. 4C is a partial enlarged view of the impeller in FIG. 4A. FIG. 4D is a top view of the impeller in FIG. 4A. FIG. 5A and FIG. 5B are perspective diagrams of the impeller according to one embodiment. FIG. 6A and FIG. 6B are perspective diagrams of the impeller according to one embodiment.

In FIG. 4A to FIG. 4D, an impeller Ia includes a hub 1 and a plurality of blades 2*a*. The hub 1 includes a shaft 14. The blades 2*a* surround the hub 1. In the rotation direction of the impeller Ia, each blade 2*a* includes an inner edge 21*a*, a leading edge 23*a*, an outer edge 22*a*, a middle portion 27*a* and a trailing edge 24*a*. The leading edge 23*a*, the outer edge 22*a* and the trailing edge 24*a* are around three sides of the middle portion 27*a*. In radial direction, the upper surface 25*a* of the blade 2*a* near the outer edge 22*a* includes a groove structure Ga. The lower surface 26*a* of the blade 2*a* relating to the groove structure Ga includes a peak structure Qa. The lower surface 26*a* of the blade 2*a* includes a recess structure S aside the trailing edge 24*a* or the leading edge 23*a*. The blade 2*a* has at least five airfoils from the inner edge 21*a* to the outer edge 22*a*. For example, seven airfoils as illustrated in the previous embodiments, or more airfoils with at least ten, at least fifteen, or at least twenty, etc. The blade 2*a* is defined by continuously connecting the airfoils at different sections in sequence so as to form the groove structure Ga and the peak structure Qa respectively on the upper surface 25*a* and the lower surface 26*a*. The groove structure Ga and the peak structure Qa are aside the outer edge 22*a* of the blade 2*a*. In addition, as the blade 2*a* is defined by continuously connecting the airfoils at different sections in sequence, the groove structure Ga is formed on the upper surface 25*a*, and the peak structure Qa as well as the recess structure S are formed on the lower surface 26*a*.

In FIG. 4A and FIG. 4B, a depth of the groove structure Ga varies along a direction from the leading edge 23*a* to the trailing edge 24*a*. A height of the peak structure Qa varies along the direction from the leading edge 23*a* to the trailing edge 24*a*. Variations of the groove structure Ga and the peak structure Qa are continuous and gradual on the upper surface 25*a* and the lower surface 26*a*. The groove structure Ga is connected to the leading edge 23*a* and the trailing edge 24*a*. The peak structure Qa is connected to the leading edge 23*a* and the trailing edge 24*a*. In another embodiment, the groove structure Ga may be not connected to the leading edge 23*a* and the trailing edge 24*a*, or it may be connected to one of the leading edge 23*a* and the trailing edge 24*a*; the peak structure Qa may be not connected to the leading edge 23*a* and the trailing edge 24*a*, or it may be connected to one of the leading edge 23*a* and the trailing edge 24*a*.

In FIG. 4A and FIG. 4B, the recess structure S is connected to the peak structure Qa. The recess structure S is connected to the outer edge 22*a*. In another embodiment, the recess structure S may be not connected to the peak structure Qa. The recess structure S may be not connected to the outer edge 22*a*.

The recess structure S may be connected to the trailing edge 24*a* or the leading edge 23*a*, or the recess structure S may be connected to the trailing edge 24*a* and the leading edge 23*a*. These configurations are respectively shown in FIGS. 4A-4B, FIGS. 5A-5B and FIGS. 6A-6B.

In FIG. 4A and FIG. 4B, the recess structure S is connected to the trailing edge 24*a*. The lower surface 26*a* has a zone 261*a* from the trailing edge 24*a* toward the leading edge 23*a* to a recess border 28*a*. A ratio of a distance between the recess border 28*a* and the trailing edge 24*a* to a distance between the recess border 28*a* and the leading edge 23*a* is smaller than 1/2. The recess structure S is within the zone 261*a* aside the trailing edge 24*a* and is not beyond the recess border 28*a*. An area of the recess structure S at the lower surface 26*a* is smaller than 1/3 of a total area of the lower surface 26*a*.

In FIG. 5A and FIG. 5B, the recess structure S is connected to the leading edge 23*a*. The lower surface 26*b* has a zone 262*b* from the leading edge 23*b* toward the trailing edge 24*b* to a recess border 29*b*. A ratio of a distance between the recess border 29*b* and the leading edge 23*b* to a distance between the recess border 29*b* and the trailing edge 24*b* is smaller than 1/2. The recess structure S is within the zone 262*b* aside the leading edge 23*b* and is not beyond the recess border 29*b*. An area of the recess structure S at the lower surface 26*b* is smaller than 1/3 of a total area of the lower surface 26*b*.

In FIG. 6A and FIG. 6B, the recess structure S has two parts which are respectively connected to the trailing edge 24*c* and the leading edge 23*c*. The recess structure S is connected to the trailing edge 24*c*. The lower surface 26*c* has a zone 261*c* from the trailing edge 24*c* toward the leading edge 23*c* to a recess border 28*c*. A ratio of a distance between the recess border 28*c* and the trailing edge 24*c* to a distance between the recess border 28*c* and the leading edge 23*c* is smaller than 1/2. The recess structure S within the zone 261*c* is aside the trailing edge 24*c* and not beyond the recess border 28*c*. An area of the recess structure S at the zone 261*c* is smaller than 1/3 of a total area of the lower surface 26*c*. The recess structure S is connected to the leading edge 23*c*. The lower surface 26*c* has a zone 262*c* from the leading edge 23*c* toward the trailing edge 24*c* to a recess border 29*c*. A ratio of a distance between the recess border 29*c* and the leading edge 23*c* to a distance between the recess border 29*c* and the trailing edge 24*c* is smaller than 1/2. The recess structure S within the zone 262*c* is aside the leading edge 23*c* and not beyond the recess border 29*c*. An area of the recess structure S at the zone 262*c* is smaller than 1/3 of a total area of the lower surface 26*b*.

In FIG. 4D, each leading edge 23*a* of the blade 2*a* has a forefront point 231*a*. When viewing the upper surfaces 25*a* of the blades 2*a*, a plurality of imaginary lines are from the shaft 14 respectively to the forefront points 231*a*. Every two adjacent imaginary lines define one included angle n. The included angles n1~n5 are distinct from each other. Among the included angles n1~n5, the difference between the maximum and the minimum is not greater than 30 degrees or not greater than 15 degrees; the difference between the maximum and the minimum is greater than 1 degree, or greater than 3 degrees, or greater than 5 degrees.

In summary, as to the impeller and the fan blade, from the shaft of the hub outwardly, the height of the leading edge to the horizontal plane of the lowest position of the blade gradually decreases first and then gradually increases. When the fan rotates, the magnitude of the airstream from the lower surface of the blade cause by the pressure difference between the upper and lower surfaces of the blade can be reduced. Thus, the turbulence on the blade and noise can be reduced. Moreover, in radial direction, the upper surface of the blade near the outer edge includes a groove structure, and the lower surface of the blade relating to the groove structure includes a peak structure. Therefore, the noise and turbulence caused by the rotational impeller can be reduced. Such blade design can raise air pressure and air volume and reduce noise. In addition, the recess structure on the lower surface of the blade is designed for raising air pressure. With the recess structure as well as the unequal pitch between blades, noise also can be reduced. Thus, the material cost is reduced and performance of the device is enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An impeller, comprising:

a hub, including a shaft; and a plurality of blades surrounding the hub, wherein each blade includes a leading edge, an outer edge, a middle portion and a trailing edge in the rotation direction of the impeller, wherein the leading edge, the outer edge and the trailing edge are around three sides of the middle portion, wherein in radial direction, an upper surface of the blade near the outer edge includes a groove structure, a lower surface of the blade relating to the groove structure includes a peak structure, the lower surface of the blade includes a recess structure aside the trailing edge or the leading edge, the recess structure is connected to the peak structure;

wherein the blade has at least five airfoils from the inner edge to the outer edge, the blade is defined by continuously connecting the at least five airfoils at different sections in sequence so as to form the groove structure and the peak structure respectively on the upper surface and the lower surface, the groove structure and the peak structure are aside the outer edge of the blade, a depth of the groove structure varies from the leading edge to the trailing edge, a height of the peak structure varies from the leading edge to the trailing edge, and variations of the groove structure and the peak structure are continuous and gradual on the upper surface and the lower surface.

2. The impeller as recited in claim 1, wherein the recess structure is connected to the outer edge.

3. The impeller as recited in claim 1, wherein the recess structure is connected to the trailing edge or the leading edge.

4. The impeller as recited in claim 1, wherein the lower surface has a zone from the trailing edge toward the leading edge to a recess border, a ratio of a distance between the recess border and the trailing edge to a distance between the recess border and the leading edge is smaller than 1/2, the recess structure is within the zone aside the trailing edge and is not beyond the recess border.

5. The impeller as recited in claim 1, wherein the lower surface has a zone from the leading edge toward the trailing edge to a recess border, a ratio of a distance between the recess border and the leading edge to a distance between the recess border and the trailing edge is smaller than 1/2, the recess structure is within the zone aside the leading edge and is not beyond the recess border.

6. The impeller as recited in claim 1, wherein an area of the recess structure at the lower surface is smaller than 1/3 of a total area of the lower surface.

7. The impeller as recited in claim 1, wherein each one of the blades has a forefront point, when viewing the upper surfaces of the blades, a plurality of imaginary lines are from the shaft respectively to the forefront points, every two adjacent imaginary lines define one included angle, the included angles are distinct from each other.

8. The impeller as recited in claim 1, wherein the groove structure is connected to the leading edge and the trailing edge, and the peak structure is connected to the leading edge and the trailing edge.

9. An impeller, comprising:

a hub, including a shaft; and a plurality of blades surrounding the hub, wherein each blade includes a leading edge, an outer edge, a middle portion and a trailing edge in the rotation direction of the impeller, wherein the leading edge, the outer edge and the trailing edge are around three sides of the middle portion, wherein in radial direction, an upper surface of the blade near the outer edge includes a groove structure, a lower surface of the blade relating to the groove structure includes a peak structure, the lower surface of the blade includes a recess structure aside the trailing edge or the leading edge, the recess structure is connected to the peak structure, the recess structure is connected to the outer edge, the recess structure is connected to the trailing edge or the leading edge;

wherein the blade has at least five airfoils from the inner edge to the outer edge, the blade is defined by continuously connecting the at least five airfoils at different sections in sequence so as to form the groove structure and the peak structure respectively on the upper surface and the lower surface, the groove structure and the peak structure are aside the outer edge of the blade, a depth of the groove structure varies from the leading edge to the trailing edge, a height of the peak structure varies from the leading edge to the trailing edge, and variations of the groove structure and the peak structure are continuous and gradual on the upper surface and the lower surface.

10. The impeller as recited in claim 9, wherein an area of the recess structure at the lower surface is smaller than 1/3 of a total area of the lower surface;

wherein each one of the blades has a forefront point, when viewing the upper surfaces of the blades, a plurality of imaginary lines are from the shaft respectively to the forefront points, every two adjacent imaginary lines define one included angle, the included angles are distinct from each other;

wherein the groove structure is connected to the leading edge and the trailing edge, and the peak structure is connected to the leading edge and the trailing edge.

11. An impeller, comprising:

a hub, including a shaft; and a plurality of blades surrounding the hub, wherein each blade includes an inner edge, a leading edge, an outer edge, a middle portion and a trailing edge in the rotation direction of the impeller, wherein the leading edge, the outer edge and the trailing edge are around three sides of the middle portion, wherein in radial direction, an upper surface of the blade near the outer edge includes a groove structure, a lower surface of the blade relating to the groove structure includes a peak structure, the lower surface of the blade includes a recess structure aside the trailing edge or the leading edge;

wherein the blade has at least five airfoils from the inner edge to the outer edge, the blade is defined by continuously connecting the at least five airfoils at different sections in sequence so as to form the groove structure and the peak structure respectively on the upper surface and the lower surface, the groove structure and the peak structure are aside the outer edge of the blade.

12. The impeller as recited in claim 11, wherein the recess structure is connected to the peak structure.

13. The impeller as recited in claim 11, wherein the recess structure is connected to the outer edge.

14. The impeller as recited in claim 11, wherein the recess structure is connected to the trailing edge or the leading edge.

15. The impeller as recited in claim 11, wherein the lower surface has a zone from the trailing edge toward the leading edge to a recess border, a ratio of a distance between the recess border and the trailing edge to a distance between the recess border and the leading edge is smaller than 1/2, the recess structure is within the zone aside the trailing edge and is not beyond the recess border.

16. The impeller as recited in claim 11, wherein the lower surface has a zone from the leading edge toward the trailing edge to a recess border, a ratio of a distance between the recess border and the leading edge to a distance between the recess border and the trailing edge is smaller than 1/2, the recess structure is within the zone aside the leading edge and is not beyond the recess border.

17. The impeller as recited in claim 11, wherein an area of the recess structure at the lower surface is smaller than 1/3 of a total area of the lower surface.

18. The impeller as recited in claim 11, wherein each one of the blades has a forefront point, when viewing the upper surfaces of the blades, a plurality of imaginary lines are from the shaft respectively to the forefront points, every two adjacent imaginary lines define one included angle, the included angles are distinct from each other.

19. The impeller as recited in claim 11, wherein a depth of the groove structure varies along a direction from the leading edge to the trailing edge, a height of the peak structure varies along the direction from the leading edge to the trailing edge, and variations of the groove structure and the peak structure are continuous and gradual on the upper surface and the lower surface.

20. The impeller as recited in claim 11, wherein the groove structure is connected to the leading edge and the trailing edge, and the peak structure is connected to the leading edge and the trailing edge.

* * * * *